US005109952A

United States Patent [19]

Starks et al.

[11] Patent Number: 5,109,952

[45] Date of Patent: May 5, 1992

[54] MOBILE AND ADJUSTABLE SCAFFOLD SYSTEM FOR TUNNEL ROOFING AND OTHER APPLICATIONS

[76] Inventors: John W. Starks; E. Wayne Kyle, both of Starks Construction Company, Inc., 401 Main St., P.O. Box 5, Silt, Colo. 81652

[21] Appl. No.: 609,928

[22] Filed: Nov. 6, 1990

[51] Int. Cl.[5] ..... E06C 5/00

[52] U.S. Cl. ..... 182/63; 182/141; 182/69

[58] Field of Search ..... 182/63, 69, 141, 132, 182/210, 62.5, 148; 187/18

[56] References Cited

U.S. PATENT DOCUMENTS

| | | | |
|---|---|---|---|
| 3,452,837 | 7/1969 | Herrell et al. | 182/63 |
| 3,495,519 | 2/1970 | Alfsen et al. | 95/36 |
| 3,516,512 | 6/1970 | Kupke et al. | 182/16 |
| 3,556,249 | 1/1971 | Jackson | 182/16 |
| 3,643,604 | 2/1972 | Jones et al. | 108/5 |
| 3,989,302 | 11/1976 | Arrington . | |
| 4,051,682 | 10/1977 | Lockwood, Jr. | 61/45 R |
| 4,064,999 | 12/1977 | Young | 214/1 SW |
| 4,070,807 | 1/1978 | Smith, Jr. | 182/141 X |
| 4,252,475 | 2/1981 | Cobb et al. | 405/291 |
| 4,260,297 | 4/1981 | Houston | 405/303 |
| 4,282,794 | 8/1981 | Miller et al. | 182/63 X |
| 4,284,368 | 8/1981 | Albright | 405/291 |
| 4,307,982 | 12/1981 | Nelson et al. | 405/297 |
| 4,356,887 | 11/1982 | Fisher et al. | 182/63 |
| 4,405,116 | 9/1983 | Eisenberg | 254/122 |
| 4,439,064 | 3/1984 | van der Garden . | |
| 4,518,061 | 5/1985 | Wehmeyer et al. | 187/18 |
| 4,614,251 | 9/1986 | Hawkins | 182/63 |
| 4,629,369 | 12/1986 | Cox et al. | 405/303 |
| 4,710,064 | 12/1987 | Stafford et al. | 405/290 |
| 4,737,051 | 4/1988 | Bull | 405/291 |
| 4,919,234 | 4/1990 | Pearson et al. | 182/141 X |

FOREIGN PATENT DOCUMENTS

| | | | |
|---|---|---|---|
| 1075816 | 2/1960 | Fed. Rep. of Germany | 182/63 |
| 2554800 | 5/1985 | France | 182/63 |

*Primary Examiner*—Karen J. Chotkowski
*Attorney, Agent, or Firm*—Beaton & Swanson

[57] ABSTRACT

An improved scaffold system suitable for tunnel roofing and siding, and other applications above and below the ground is disclosed. This invention is a diesel powered, hydraulically actuated, mobile and adjustable scaffold system that an operator can drive into a work area, such as a tunnel. Once at the work area, the operator can address the work face head on, and can adjust the workpiece carried on the work bearing surface of the system in every possible dimension.

This invention comprises a self-powered vehicle assembly and a multi-table assembly. The vehicle assembly provides a general level of mobility and maneuverability to the entire system. The multi-table assembly mounted on top of the vehicle assembly includes several movable tables, the top one of which supports a work bearing surface. The multi-table assembly provides further and more detailed mobility and maneuverability to the work bearing surface of the system so as to provide for precise adjustment and positioning of a workpiece situated on the work bearing surface relative to the work face where the workpiece is to be placed.

34 Claims, 9 Drawing Sheets

SEE FIG 4b
SEE FIG 4a 200
210
215
220
225
230
235
240
245
247
249
255
260
263
265
310
335
347
349
130
6
5

MOBILE AND ADJUSTABLE SCAFFOLD SYSTEM FOR TUNNEL ROOFING AND OTHER APPLICATIONS

BACKGROUND OF THE INVENTION

This invention pertains to scaffolds, and more particularly to a diesel powered, hydraulically actuated, mobile and adjustable scaffold system which provides a work bearing surface adjustable in all dimensions and adapted, among other uses, to the placement of massive roofing tile panels and panel grids in tunnels. Although it should be understood that this invention has several uses, including roofing and siding installations both above and below ground, the discussion which follows will illustrate its use in the context of placing roof tiles in highway tunnels.

In building road tunnels, existing techniques that involve the placement of tiled roof panels typically require that each panel be placed individually. The individual placement of such panel tiles, each of which may be up to four feet by ten feet in dimension and weigh in excess of 200 pounds is time consuming and expensive. Those existing devices that comprise self-propelled, mobile powered vehicles to set roof sections in place, or to set a roof, typically are designed for, and must be used in, specific and pre-determined means and methods of construction. These pre-determined means and methods may require that the mobile device itself be mounted on tracks, or may require that it extrude a more or less continuous ceiling layer. Further, such devices are typically limited to the single purpose kind of operation for which they were designed, are relatively specialized, and not easily adaptable for different construction modes or methods.

The preferred embodiment of this invention provides a work bearing surface that is approximately 18 feet by 30 feet, and which can lift up to 20,000 pounds. The work bearing surface of this invention is mobile and adjustable in all dimensions.

It is an object of the present invention to provide a mobile, self-powered and self contained machine that permits workers easily, safely and rapidly to pre-assemble an entire grid of roof panel tiles on the ground (or on the work bearing surface of the system itself), to transfer the pre-assembled grid of roof panel tiles onto the work bearing surface of the system, and to lift and guide the pre-assembled grid into place, aligning the new grid section precisely in all dimensions so as to assume the exact position required. The position of the new grid section delivered by the device of the present invention may be set relative to roof sections already in place, or according to desired specifications.

It is a further object of this invention to provide a highly mobile and extremely versatile scaffolding system inasmuch as it may be driven under its own power and readily maneuvered about the job site. All of its component assemblies and sub-assemblies operate individually and each of them can perform a different function. Further, the present invention is fabricated of non-specialized parts and so is easily maintained and serviced.

Using this invention for placing a roof in a tunnel, for example, an operator can lift massive single pieces, or can have a crew assemble grids of tunnel ceiling tiles either (a) on a frame on the ground, and then lift the frame onto the work bearing surface of the top table of the system for placement, or (b) on the work bearing surface of the top table of the system itself. As a result, tile can be placed faster, more efficiently and more cheaply than could be done without this invention. Further, the system is mobile, reusable and almost infinitely adjustable. The system is relatively easy to maintain because it uses standard parts and components, it is easy to drive and operate because it never needs to be backed up and because all four wheels steer, it is relatively inexpensive when compared to other mobile tunnel roofers, and it is more efficient than laying the ceiling tiles one by one. Other significant improvements afforded by this invention will be easily understood in connection with the detailed description of the system.

Accordingly, the present invention is a system which addresses problems of scaffolding generally, and of tunnel roofing in particular, providing a faster, more accurate and more efficient means of placing panel tiles and grids of panel tiles, and providing a more mobile, more versatile, and more readily maintained and serviced means of doing so than previously available.

SUMMARY OF THE INVENTION

This invention is a diesel powered, hydraulically actuated, mobile and adjustable scaffold system that an operator can drive into a work area, such as a tunnel. Once at the work area, the operator can address the work face head on, and can adjust the workpiece carried on the work bearing surface of the system in every possible dimension.

This invention comprises a vehicle assembly and a multi-table assembly. The vehicle assembly provides a general level of mobility and maneuverability to the entire system. The multi-table assembly mounted on top of the vehicle assembly includes several movable tables, the top one of which supports a work bearing surface. The multi-table assembly provides further and more detailed mobility and maneuverability to the work bearing surface of the system so as to provide for precise adjustment and positioning of a workpiece situated on the work bearing surface relative to the work face where the workpiece is to be placed.

DETAILED DESCRIPTION OF THE PREFERRED EMBODIMENT

Overview of the System

Figure 1:
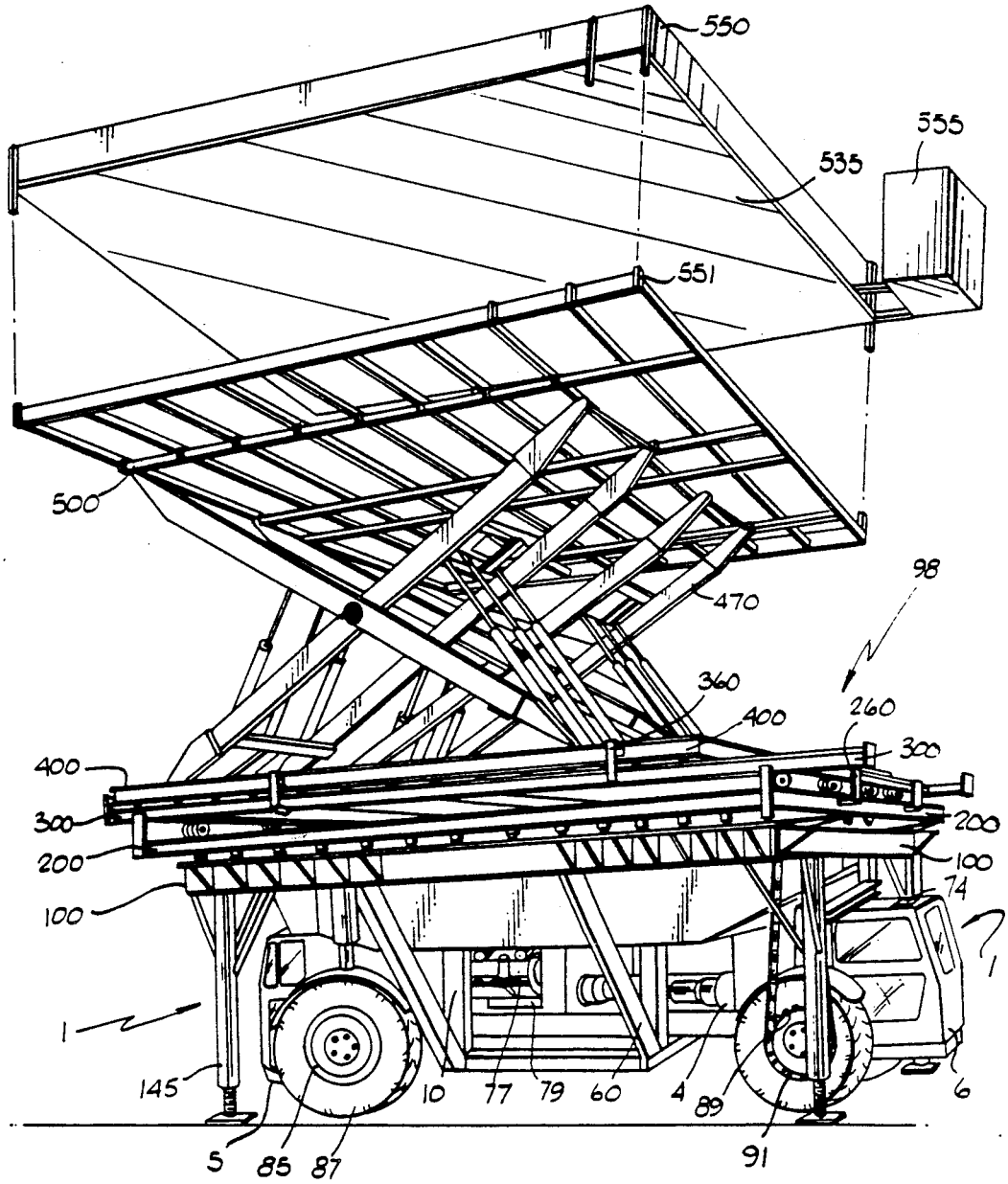
FIG. 1 is a view, partially in perspective, of the invention.

An overview of the entire system, and an orientation to its various components is given in FIG. 1. The system comprises a vehicle assembly 1 and a multi-table assembly 98.

The vehicle assembly 1 includes: operation means, not separately numbered, for operating the system; support means, not separately numbered, for bearing the system; and motive force means 4 for imparting motion to the system. The multi-table assembly 98 includes five movable table means for positioning a workpiece. The five movable table means, stacked pancakewise on top of the vehicle assembly 1 and on top of one another, are: a first movable table means 100 for pitch/yaw and leveling motion; a second movable table means 200 for rotational motion; a third movable table means 300 for left/right motion; a fourth movable table means for front/back motion; and a fifth movable table means 500 for up/down motion.

An overview of the major components of the vehicle assembly 1 will be given, still with reference to FIG. 1. The operation means includes a front operator cab 5, and a back operator cab 6, one at either end of the vehicle assembly. The support means includes a vehicle box frame 10 positioned between said cabs and beneath the multi-table assembly 98. The motive force means 4 is situated within the vehicle box frame 10 and comprises (a) a self-contained power means, not separately numbered, for moving the vehicle assembly 1 and for imparting motion to the several tables of the multi-table assembly 98, which self-contained power means includes a diesel engine 77 and a hydraulic system 79, and (b) a mobility means, not separately numbered, for assisting in moving the vehicle assembly 1, and which mobility means includes four steerable wheels 85, four rubber tires 87, two toothed hubs 89, and two drive chains 91.

Next, an overview of the major components of the multi-table assembly 98 will be given, still with reference to FIG. 1. Each of the five movable table means, 100, 200, 300, 400 and 500, of the multi-table assembly 98 cooperates with the vehicle assembly 1, or another movable table means so as to provide a full range of motion to the work bearing surface of the invention.

The first movable table means 100 of the multi-table assembly 98 acts as the base of the multi-table assembly and is also sometimes referred to herein as the "base table sub-assembly." The base table sub-assembly 100 is rigidly connected to the vehicle box frame 10 of the vehicle assembly 1, and is braced four ways, twice on either side, by braces 60. The base table sub-assembly 100 includes four hydraulically actuated piston legs 145 sometimes referred to herein as "outriggers," one at each corner of the base table. The outriggers 145 can contract so as to allow the rubber tires 87 of the vehicle assembly 1 to contact the ground and move the entire system, or the outriggers 145 can extend so as to lift the rubber tires 87 of the vehicle assembly 1 off of the ground, stabilizing and providing a solid work base for the system.

The second movable table means 200 is slidably mounted on top of the first movable table means 100 and is rotatably fixed to the support means of the vehicle assembly 1 by a pivot post (not visible in FIG. 1, but shown and discussed subsequently) so as to enable a range of rotational motion in the second movable table, in ⅛ inch increments, as said second movable table 200 rotates above and parallel to the plane of the first movable table 100. Movement is imparted to the second movable table means 200 through two hydraulically actuated jacks (not visible in FIG. 1, but shown and discussed subsequently) each of which is pinned, at one end thereof, to the upper surface of the first movable table and, at the other end thereof, to the bottom surface of the second movable table.

The third movable table means 300 is slidably mounted on top of the second movable table means 200 and is guided laterally over the second table by four retaining guides 260, two of which are visible in FIG. 1, and which are discussed in more detail subsequently, so as to enable a range of lateral motion in the third movable table, up to four feet left and right (two feet left of center, and two feet right of center), as said third movable table 300 translates to the left and right above and parallel to the plane of the second movable table 200. Movement is imparted to the third movable table means 300 through a hydraulically actuated jack (not visible in FIG. 1, but shown and discussed subsequently) which is pinned, at one end thereof, to the upper surface of the second movable table and, at the other end thereof, to the bottom surface of the third movable table.

The fourth movable table means 400 is slidably mounted on top of the third movable table means 300 and is guided laterally over the third table by four retaining guides 360, two of which are visible in FIG. 1, and which are discussed in more detail subsequently, so as to enable a range of lateral motion in the fourth movable table, up to four feet front and back (two feet to the front, and two feet to the back), as said fourth movable table 400 translates to the front and back above and parallel to the plane of the third movable table 300. Movement is imparted to the fourth movable table means 400 through a hydraulically actuated jack (not visible in FIG. 1, but shown and discussed subsequently) which is pinned, at one end thereof, to the upper surface of the third movable table and, at the other end thereof, to the bottom surface of the fourth movable table.

The fifth movable table means 500, which is the topmost of the five movable table means, constitutes, on the upper surface thereof, a work bearing surface, and is equipped with a floor 535 and safety railings 550. Said safety railings are removably seated in rectangular pockets 551 appropriately spaced about the outer periphery of the fifth table 500 so that the safety railings can be removed and installed as needed. Four lookout stations 555 (one of which is shown in FIG. 1), each consisting of a cage suitable for holding a person acting as a lookout operator, are removably attached to the outer corners of said fifth table so that the lookout stations can be removed and installed as needed. The fifth movable table 500 is liftably mounted on top of the fourth movable table means 400 by a pair of scissors lift mechanisms 470 so as to enable a range of upward motion in the fifth movable table, up to 13 feet, 6 inches, as said fifth movable table 500 elevates above the plane of the fourth movable table 400.

The foregoing overview of the cooperation of the various components of this invention will be supplemented in the course of the more detailed discussion which follows, and with reference to the corresponding figures, but it should be apparent already that the range of motion afforded by this invention is provided, in some part, by the vehicle assembly 1 but, for the most part, by the multi-table assembly 98. It should be further apparent that the first movable table means 100, once set for the desired pitch/yaw or levelled, constitutes a stable base for the system, and that the fifth movable table means 500 constitutes a safe and versatile work bearing surface that supports the workpiece, and the workmen, employed by the system.

Having completed a description of an overview of this invention, the system will be described in detail, commencing with the vehicle assembly 1, and then continuing to each of the five movable table means of the multi-table assembly 98, in turn.

In the following discussion and the accompanying views, certain conventions concerning front and back, left and right, and other directions are followed throughout. Front and back describes a range of translational motion along an axis extending through the front operator cab 5 and the back operator cab 6. Left and right describes a range of translational motion along an axis extending at right angles to the front/back axis and with the two axes describing a horizontal plane. In the views of the several movable table means, the front operator cab 5 will be indicated at the left, and back operator cab 6 will be indicated at the right so as to provide a ready orientation. When indicating frame members, "front/back" frame members will refer to the members on the periphery of the frame which are drawn from top to bottom across the views (a front frame member at the front of the vehicle and a back frame member at the back of the vehicle), and "left/-right" frame members will refer to the members on the periphery of the frame which are drawn from left to right across the views (a left frame member at the left of the vehicle and a right frame member at the right of the vehicle). "Longitudinal" members and "length" will refer to members or lines drawn left to right across the figures in the views and parallel to the left/right frame members, while "latitudinal" members or "width" will refer to members or lines drawn top to bottom across the figures in the views and parallel to the front/back frame members. The same conventions will be used in perspective views, making the appropriate allowances for perspective front/back and left/right.

The Vehicle Assembly

Figure 2:
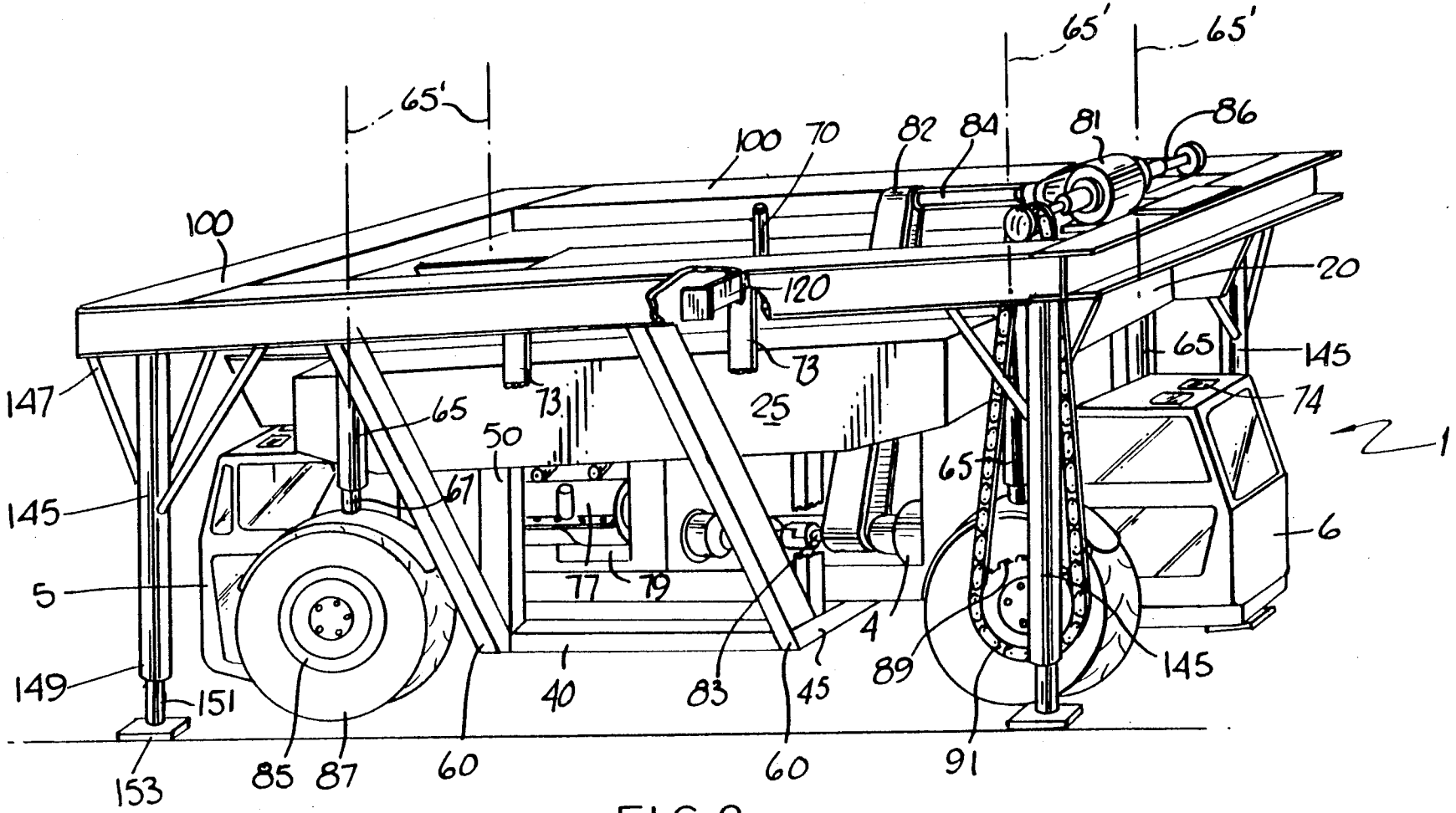
FIG. 2 is a view, partially in perspective, of the vehicle assembly of the system with a schematic view of the first movable table attached on top of the vehicle assembly.

With reference to FIG. 2, the vehicle assembly 1 can be seen to include: operation means, not separately numbered, for operating the system; support means, not separately numbered, for bearing the system; and motive force means 4 for imparting motion to the system. The operation means includes a front operator cab 5, and a back operator cab 6, one at either end of the vehicle assembly. Each of the operator cabs has a conventional set of steering, shifting and other usual vehicle operating controls (not visible in FIG. 2, but shown and discussed subsequently) so that the vehicle assembly 1 of this invention is driveable from either end. In addition, each of the operator cabs also is adapted to have a set of conventional controls (not visible in FIG. 2, but shown and discussed subsequently) for the hydraulically actuated members of the system, indicator lights to show the status of the movable tables, and a hemispherically shaped bubble gauge (not shown) to indicate whether the system is level so that this invention may be fully operable from either end.

The support means include a vehicle box frame 10 positioned between said operator cabs 5 and 6 and beneath the first movable table means 100. The vehicle box frame 10 is a box made of a top rectangular frame, not separately numbered, and a bottom rectangular frame, not separately numbered, rigidly connected by four vertical post girders 50. The top rectangular frame comprises two left/right frame members 25, each eighteen feet long in the preferred embodiment, bolted to two front/back frame members 20, each twenty feet long in the preferred embodiment. The bottom rectangular frame comprises two left/right frame members 40, bolted to two front/back frame members 45. The vehicle box frame 10 has a suitable number of cross braces and framing members (not shown, but apparent to those skilled in the art). At each of the corners of the top rectangular frame of the vehicle box frame is a wheel housing 65 in which one of the four wheel pistons 67 is mounted. A pivot post 70 is rigidly affixed at the center of the vehicle box frame 10 and oriented vertically so as to provide a rotational pivot to the second movable table 200 (reference FIG. 1) as will be discussed later. Four vertical connecting members 73, two of which are shown in FIG. 2, are rigidly affixed to the left/right frame members 25 of the top frame rectangle of the vehicle box frame 10, with two said connecting members affixed to each said frame member so as to provide a connecting member to which the first movable table 100 may be rigidly connected by four cut beams 120 each fixed, at one end thereof, to the inner periphery of said first table and, at the other end thereof, to one of said vertical connecting members 73.

The motive force means 4 of the system is situated within the vehicle box frame 10 and comprises (a) a self-contained power means, not separately numbered, for moving the vehicle assembly 1 and for imparting motion to the several tables of the multi-table assembly 98 (reference FIG. 1), which self-contained power means includes a diesel engine 77 (referring now to FIG. 2) and a hydraulic system 79, and (b) a mobility means, not separately numbered, for assisting in moving the vehicle assembly 1, and which mobility means includes four steerable wheels 85, four rubber tires 87, two toothed hubs 89, and two drive chains 91.

The self-contained power means includes a diesel engine 77 and hydraulic system 79 fixedly mounted behind the front operator cab 5 and within the vehicle box frame 10. A belt 82 transfers rotational motion from the drive shaft 83 of the diesel engine 77 to the drive shaft 84 of a differential mechanism 81 fixedly mounted at the back end of the top frame rectangle of the vehicle box frame 10. A pair of chains 91, one of which is shown in FIG. 2, transfers rotational motion from the axles 86 of differential mechanism 81 to the two toothed hubs 89 so as to drive the wheels 87.

The hydraulic system 79 transfers hydraulic pressure by a system of hoses (not shown) to (a) a four wheel steering mechanism (not visible in FIG. 2, but shown and discussed subsequently) to steer the system, (b) four outriggers 145, one near each corner of the first movable table 100 to impart pitch/yaw and leveling motion to the system, (c) various jacks (not visible in FIG. 2, but shown and discussed subsequently) to impart motion to the second 200, third 300 and fourth 400 movable tables (reference FIG. 1), and (d) to the scissors lift 470 to impart motion to the fifth movable table 500.

Figure 2A:
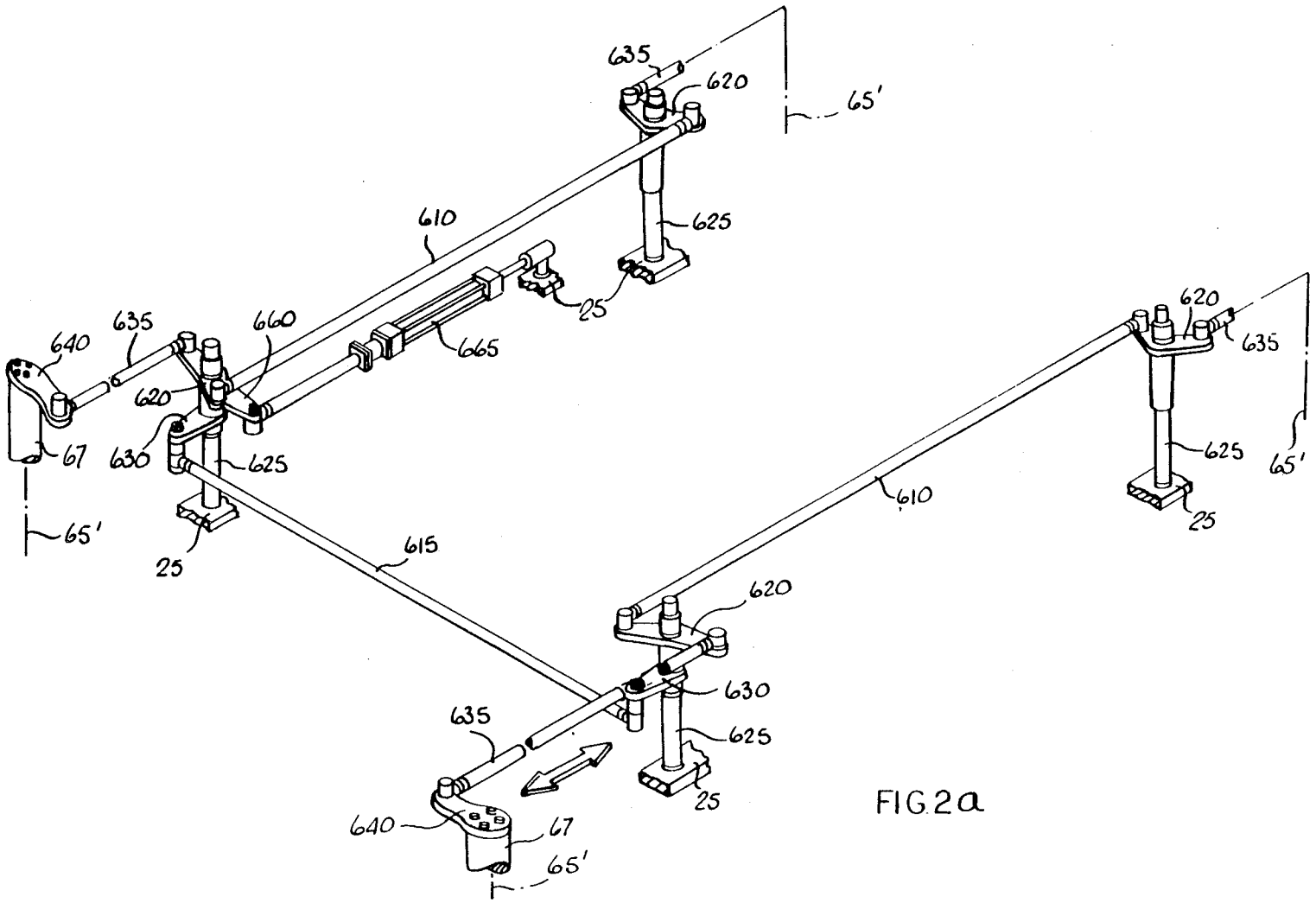
FIG. 2A is a view, partially in perspective, of the hydraulic four wheel steering linkage of the vehicle assembly.

With reference to FIG. 2, the mobility means (not separately numbered) includes four steerable wheels 85, four rubber tires 87, two toothed hubs 89, and two drive chains 91. Each of the four wheels 85 is mounted on a wheel piston 67 in a housing 65 on the vehicle box frame 10, and each of said wheels steers by a four wheel steering linkage means, not separately numbered, for steering the four wheels in unison. The four wheel steering linkage means can be best understood by reference to FIG. 2A, and includes several components. Four cam posts 625 are fixed to the interior of the left/right frame members 25 of the top rectangular frame of the vehicle box frame 10 (reference FIG. 2) on the horizontal surface formed on the interior lip of the frame members 25. A left/right tie cam 630 is rotatably mounted on each of the two front cam posts 625. A front/back tie cam 620 is rotatably mounted on all four of the cam posts 625. A left/right tie bar 615 rotatably links the two left/right tie cams 630. A front/back tie bar 610 rotatably links the two front/back tie cams 620 shown at the bottom left and bottom right of FIG. 2A, and another front/back tie bar 610 rotatably links the two front/back tie cams 620 shown at the top left and top right of FIG. 2A. A front/back extender 635 is rotatably linked, at one end thereof, to each of the front/back tie cams 620, and at the other end thereof, to a wheel piston shoe 640 (only two of which are shown in FIG. 2A, the other two being mirror images). Each said wheel piston shoe is rigidly affixed to a wheel piston 67 and is mounted above and centered on the center bore 65' of the wheel housings 65 (reference FIG. 2). The steering linkage formed by said tie bars and extenders can be seen to link all four wheel pistons 67 so that all four will turn in unison upon the application of a motive force to said linkage. With reference to FIG. 2A, motive force is imparted to the steering linkage by a hydraulic jack 665, pivotally fixed, at one end thereof, to a front/back frame member 25 of the vehicle box frame and, at the other end thereof, to a jack cam 660 appropriately mounted on a corresponding cam post 625.

With reference to FIG. 2, the diesel engine 77 of the motive force means of the preferred embodiment is a commercially available Cummins 4BTA 3.9P engine, delivering 125 maximum horsepower and 108 BHP working power; the hydraulic system 79 of the preferred embodiment is a dual stage system, providing 28 gallons per minute (GPM) and 8 GPM in the two stages, respectively, (14 GPM and 8 GPM, respectively, usable at 1200 RPM) so as to deliver a force of 1750 PSI to the various hydraulically actuated members of the invention; and the differential system of the preferred embodiment includes a torque converter 771 (reference FIG. 3), a directional shifting means 773 for directional shifting between forward and reverse, and a four speed transmission shifting means 774 for shifting among four gear ratios.

Referring again to FIG. 2, the frame members of the support means of the preferred embodiment are steel pipes (12 inch diameter), plates (one-half inch), flats (one-half inch by 6 inch), and beams (W6×20 lb., W8×13 lb. and W10×33 lb.), but any other suitable members may be used. The tires 87 of the mobility means of the preferred embodiment are 14:00×20, but any other suitable tires may be used. Likewise any other suitable self-contained power means and mobility means of power, hydraulics, torque conversion and propulsion may be used. In devising suitable tires, engine power, hydraulics and torque conversion, it should be realized that the present invention comprises, in its preferred embodiment, a vehicle assembly 1 weighing approximately 20,000 pounds and a multi-table assembly 98 weighing approximately 30,000 pounds designed to lift, rotate, adjust and support an effective payload of 20,000 pounds.

The combination of tires, engine, four wheel steering and hydraulics of the preferred embodiment results in a vehicle able to travel at approximately 40 miles per hour without the multi-table assembly 98, able to travel at approximately 15 miles per hour with the multi-table assembly mounted but unloaded, and able to travel at approximately 7 miles per hour fully loaded, and to support and manipulate the loads specified. The dimensions of the vehicle assembly 1 of the preferred embodiment are 22 feet from "bumper to bumper" and 9 feet from wheel to wheel, which results in a vehicle able to fit within most roads and highway lanes, able to be transported on a "lowboy" truck pallet, and able to turn in a 22 foot turning radius.

The vehicle assembly 1 is adapted, not only to support and manipulate the loads specified, but also to be easy to operate. To that end, it should be noted that, with operator cabs 5 and 6 at both ends, the operator never has to back up the vehicle, but by changing cabs, is always able to drive the vehicle in a forward direction. Likewise, with a full set of controls installed in each of the operator cabs 5 and 6, the system adapted to be fully functional from either end. Operability is further enhanced by the short turning radius achieved because all four of the wheels 87 steer. As will be described in more detail subsequently, each of the five tables (100, 200, 300, 400 and 500 with reference to FIG. 1) of the multi-table assembly 98 is independently actuated, and a separate control for each independently actuated element is located within the operator cab. The operator, seated within said cab, is able to communicate visually with a lookout operator in one of the lookout stations 555 through windows 74 in the roof of said cab, and is also able to communicate orally with the lookout operator by suitable audio devices (not shown).

Finally, the vehicle assembly 1 is adapted to receive the base table sub-assembly 100 (reference FIG. 1) of the multi-platform assembly 98. The base table 100 is removably affixed by suitable bolts (not shown) to the top rectangular frame of the vehicle box frame 10, and is supported by braces 60 running to the bottom rectangular frame of the vehicle box frame 10, as will be discussed with reference to the base table sub-assembly 100 of the multi-table assembly 98 below. Other components of the vehicle assembly 1 such as fuel holding means, braking means, headlight and tail light means, shock support means and the like are well known, readily devised, and will not be discussed.

The Multi-Table Assembly

Having finished the discussion of the vehicle assembly 1 of the present invention, each of the five movable table means of the multi-table assembly 98 (reference FIG. 1) will now be discussed, in turn. In respect of the multi-table assembly 98, and the discussion which follows, it should be noted that there are certain functional similarities among each of the movable table means.

Each of the movable table means comprises (a) a deck means for defining a rigid table, (b) a lower table interface means for connecting to the ground or to a lower component, which lower component may be the vehicle assembly 1, or may be another movable table beneath the movable table in question, and (c) a higher table interface means for connecting to a higher component, which higher component is another movable table above the movable table in question.

While each movable table is shown in its own figure, it is useful to continue to refer, from time to time, to FIG. 1 to see the relative positions of all of the tables at once. As has already been indicated, the hydraulic system 79 of the invention transfers hydraulic pressure to (a) a four wheel steering mechanism (reference FIG. 2A) to steer the system, (b) four outriggers 145 (reference FIG. 1), one near each corner of the first movable table 100 to impart pitch/yaw and leveling motion to the system, (c) various jacks (not visible in FIG. 1, but shown and discussed subsequently) to impart motion to the second 200, third 300 and fourth 400 movable tables, and (d) to the scissors lift 470 to impart motion to the fifth movable table 500. The steering mechanism hydraulic jack 665 has already been discussed with reference to FIG. 2A. The other hydraulic jacks, and their connections between adjacent tables, will be discussed, table by table.

Figures 3, 3A:
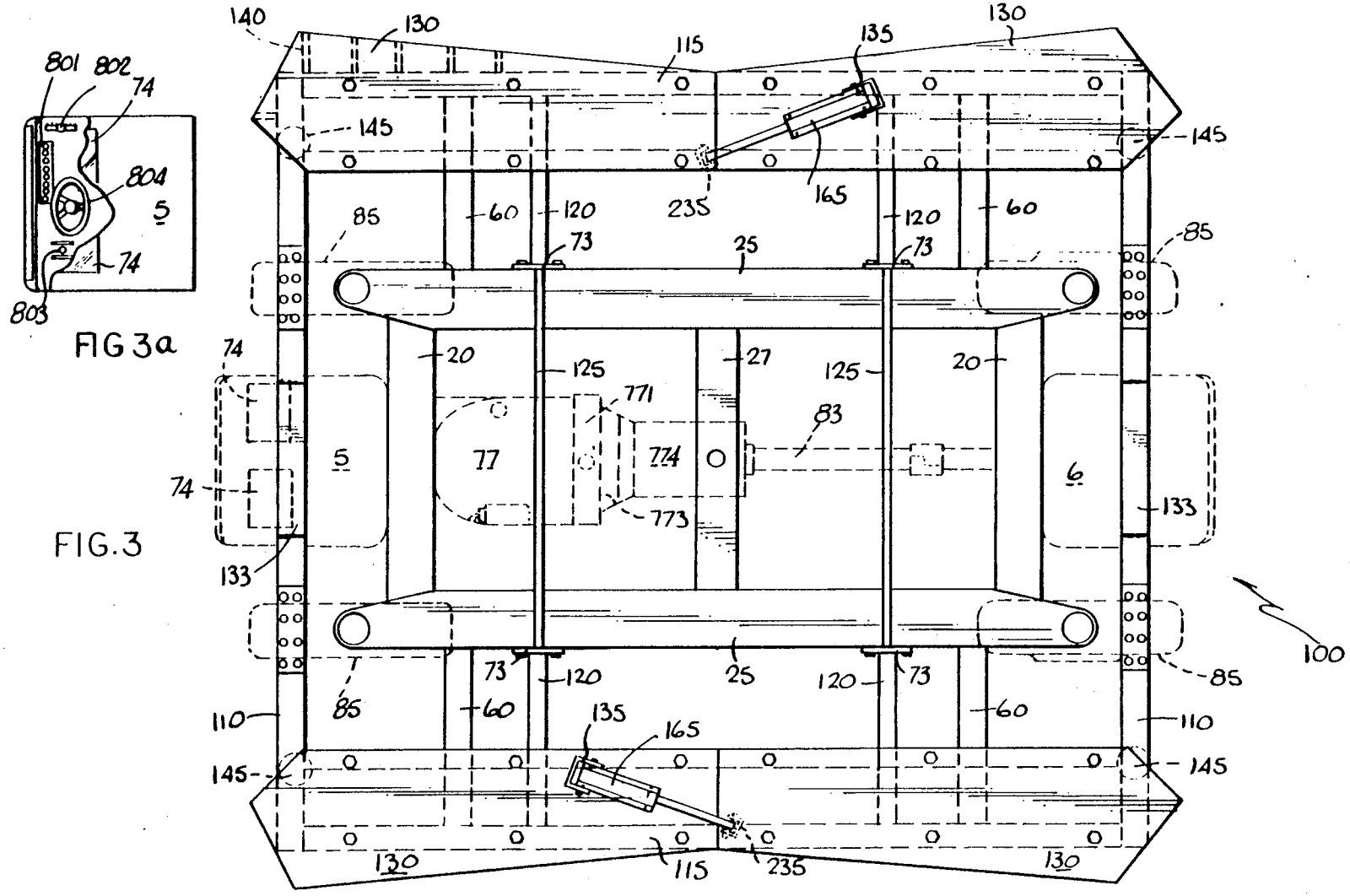
FIG. 3 is a plan view of the first movable table (pitch/yaw and leveling motion).
FIG. 3A is a detail view, from the top and partially cut away, of one of the operator cabs shown in FIG. 3.
Figures 4, 4A, 4B:
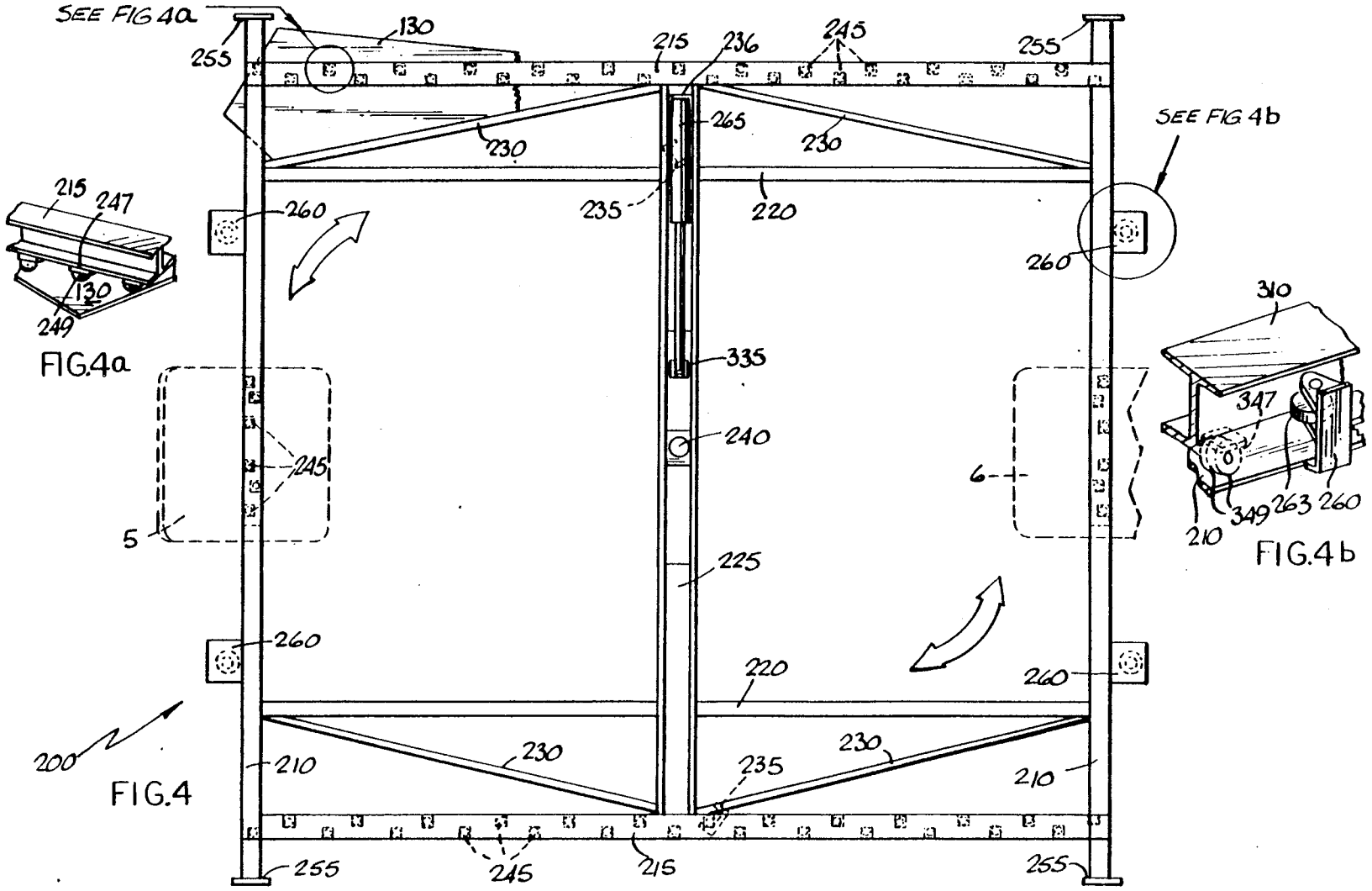
FIG. 4 is a plan view of the second movable table (rotational motion).
FIG. 4A is a detail view of roller ball casters and plates shown in FIG. 4 and of the undercarriage of the second movable table as it contacts the first movable table.
FIG. 4B is a detail view of a retaining guide shown in FIG. 4 and of the undercarriage of the third movable table as it contacts the second movable table and the retaining guide.
Figure 5:
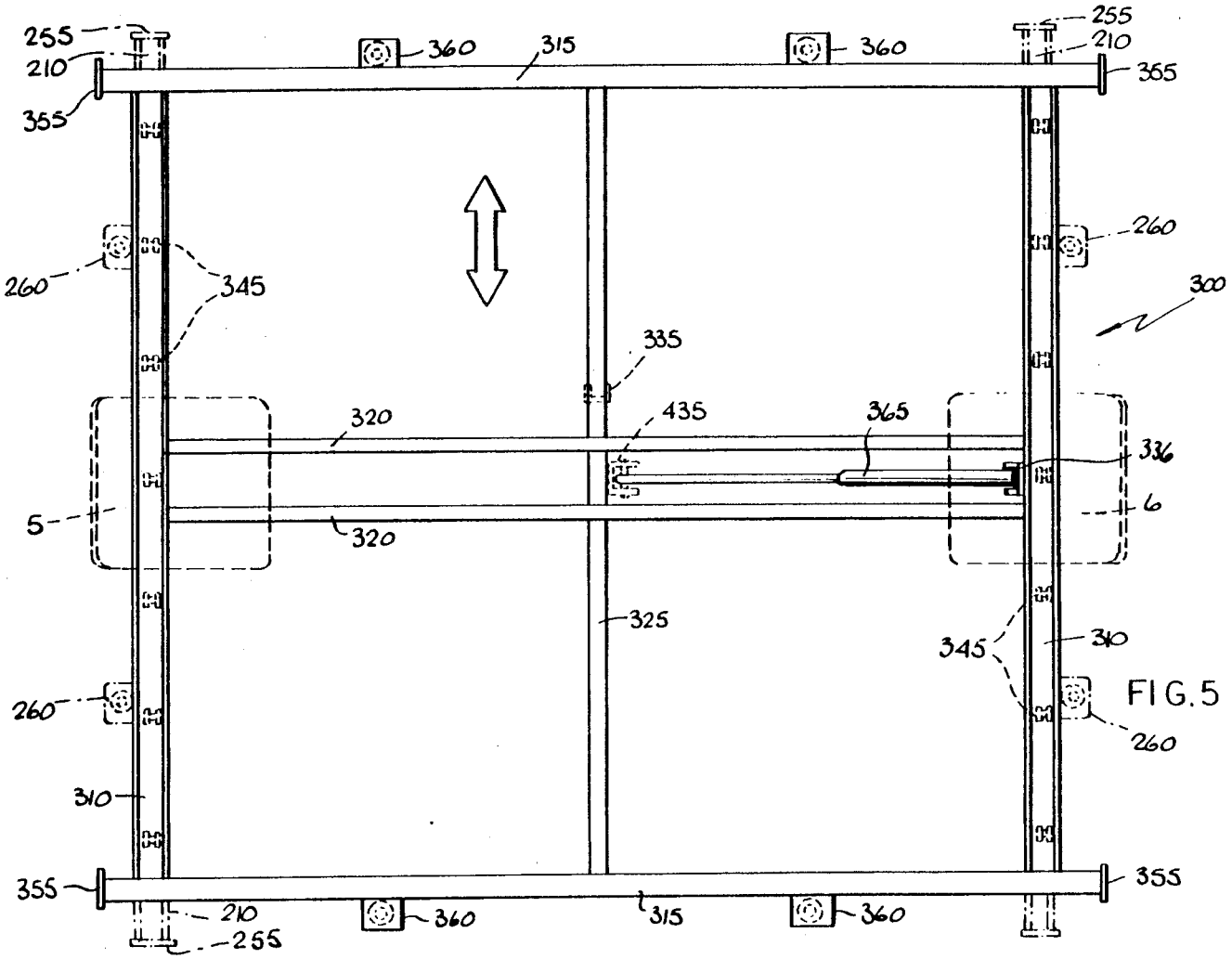
FIG. 5 is a plan view of the third movable table (left and right motion).

By way of overview of the working of the hydraulic system 79 of FIG. 1 and the multi-table assembly 98, it will be seen with reference to FIG. 3 that the first movable table 100 is moved by four outriggers 145. The second movable table is moved by a pair of jacks 165 pinned between the first movable table and contact points 235 of the second movable table 200, which jacks impart rotational motion to the second table (reference FIGS. 3 and 4). With reference to FIG. 4, it will be seen that the third movable table is moved by a jack 265 pinned between the second movable table and a contact point 335 of the third movable table 300, which jack imparts left/right lateral motion to the third table (reference FIGS. 4 and 5). With reference to FIG. 5, it will be seen that the fourth movable table is moved by a jack 365 pinned between the third movable table and a contact point 435 of the fourth table 400, which imparts front/back motion to the fourth table (reference FIGS. 5 and 6). Finally, with reference to FIG. 6A, it will be seen that the fifth movable table is moved by a pair of hydraulic scissors lifts fixed, at one end thereof, to the top of the fourth movable table and, at the other end thereof, to the bottom of the fifth movable table (reference also FIGS. 6 and 7).

The First Movable Table (Pitch/Yaw and Levelling Motion)

Now turning to FIG. 3, the first movable table means 100 can be seen to include (a) a deck means, not separately numbered, for defining a rigid table, (b) a lower table interface means, not separately numbered, for connecting to the vehicle assembly 1 and to the ground, and (c) a higher table interface means, not separately numbered, for connecting to the second movable table 200.

The deck means of the first movable table 100 comprises a rectangular table frame which includes two front/back frame members 110 and two left/right frame members 115 bolted together to form a rigid rectangular frame. The left/right members 115 of the preferred embodiment are eighteen feet long steel beams, and the front/back members 110 of the preferred embodiment are twenty feet long steel beams.

The lower table interface means includes several components. Four cut-beams 120 are disposed perpendicularly to the left/right frame members 115 of the rectangular table frame 105, and are bolted at one end thereof to said left/right frame members, and at the other end thereof to the vertical connecting members 73 of the top rectangular frame of the vehicle box frame 10 of the vehicle assembly 1, thereby rigidly affixing the first movable table means 100 to the vehicle assembly 1. Two tie rods 125 are provided, and each tie rod runs from one to another of two oppositely disposed cut-beams 120 and joins that opposing pair of cut-beams together so as to provide further support to the rectangular table frame 105. Four braces 60 are disposed, two from each of the left/right members 115 of the rectangular table frame of the first movable platform 100, rigidly downward and at an angle so as to contact the bottom rectangular frame 35 of the vehicle box frame 10, into which they are bolted so as further to secure the first movable platform 100 to the vehicle assembly 1. Four outrigger mechanisms 145 extend vertically downward from each of the four corners of the rectangular table frame 105, and will be discussed after the higher element interface means of the first table has been discussed.

The higher table interface means of the first movable table 100 includes several components. Two angled plates 130 run lengthwise on each side of the rectangular table frame, cover each of the corners thereof, and are supported near the corners by protruding angled plate supports 140. Two rectangular plates 133 are provided, one centered on top of each of the front/back frame members 110 of the rectangular table frame. The angled plates 130 and the rectangular plates 133 of the first movable table means 100 provide a horizontal planar surface on which the second movable table 200 will be seated, as will be described later. Two jacks 165 pinned between the first and second movable tables by clevis connectors 135 on the top of the first movable table and clevis connectors 235 on the bottom of the second movable table provide a mechanism by which motive force may be imparted to the second movable table 200.

The outrigger mechanisms 145 at each of the corners of the rectangular table frame of the first movable table means 100 are rigidly fastened thereto and triply braced by braces 147 (reference FIG. 2) affixed at one end thereof to the rectangular table frame and, at the other end thereof, to the outrigger mechanism. The outrigger mechanisms 145 include a piston housing 149, a piston rod 151 housed in encircling relationship within the piston housing, and a foot plate 153 attached to the exterior end of the piston rod 151. Each of the four piston rods 151 of the outrigger mechanisms 145 is hydraulically actuated, separately and individually, by one of four independent control levers, not separately numbered, but shown within the hydraulic control panel 801 (reference FIG. 3A) of one of the operator cabs 5 and 6, the front cab 5 being shown in partial cut away in FIG. 3A. The vertical dimension of each outrigger 149 is thereby hydraulically adjustable.

It can most easily be seen with reference to FIG. 2 that the piston rods 151 of the outriggers 145, when contracted within the piston housings 149, do not touch the ground, and so permit the system to be driven about. But when the system is in position for work, and the piston rods 151 are extended, the foot plates 153 first make contact with the ground and then lift the vehicle assembly 1, and the entire system, such that the system is no longer supported by the rubber tires 87 but by the outriggers 145 of the first movable table 100. In addition to providing a very stable base from which to work, the individual hydraulic adjustment of each of the outriggers 145 permits near perfect leveling of the system. Finally, considering the outriggers 145 as paired, alternately front to back, and left to right, it is possible, (a) by raising and lowering the front pair of outriggers relative to the back pair, to impart any desired amount of pitch, and (b) by raising and lowering the left pair of outriggers relative to the right pair, to impart any desired amount of yaw. The range of vertical motion provided by the piston rods 151 of the outrigger mechanisms 145 imparts a corresponding range of leveling, pitch and yaw motions to the first movable table means.

With reference to FIG. 3A, the control means of the operator cabs 5 and 6, the front cab 5 of which is shown, includes a hydraulic control panel 801. In the preferred embodiment, the control panel 801 includes eight individual controls, not separately numbered, as follows: (a) one through four, one each to actuate each of the four outriggers 145 that adjust the first movable table, (b) five, six and seven, one each to actuate each of the three jacks previously discussed, one of which jacks is fixed between the first and second tables (so as to adjust the second table), one of which jacks is fixed between the second and third tables (so as to adjust the third table), and one of which jacks is fixed between the third and fourth tables (so as to adjust the fourth table), and (c) eight, for the scissors lifts fixed between the fourth and fifth tables (so as to adjust the fifth table).

In the preferred embodiment, the control panel 801 also includes eight indicator lights not separately numbered or shown, one corresponding to each of the controls, and indicating, when lit, that: as to the outriggers 145, they are "up"; as to any of the jacks, that they are in a centered position so that the table controlled by the corresponding jack is in a centered position; and, as to the scissors lift, that it is "down" so that the fifth movable table is lowered on top of the fourth table. It can be seen, therefore, that the operator is alerted that the system is safe to be driven towards or away from the work area only when all eight lights are lit.

Other control means within the operator cab 5 include a directional shift control 802 for engaging in forward or reverse drive, a main transmission shift control 803 for engaging one of the gears, a hydraulic steering wheel 804 for engaging the hydraulic steering mechanism previously discussed, and two top windows 74 for communicating visually with a lookout operator as previously described.

The Second Movable Table (Rotational Motion)

Now turning to FIG. 4, the second movable table means 200 can be seen to include (a) a deck means, not separately numbered, for defining a rigid table, (b) a lower table interface means, not separately numbered, for connecting to the first movable table 100 and to the vehicle assembly 1, and (c) a higher table interface means, not separately numbered, for connecting to the third movable table 300.

The deck means of the second movable table 200 comprises a rectangular table frame which includes two front/back frame members 210 and two left/right frame members 215 bolted together to form a rigid rectangular frame. The left/right members 215 of the preferred embodiment are eighteen feet long steel beams, and the front/back members 210 are twenty feet long steel beams. Two longitudinal cross beams 220 are disposed parallel to the left/right members 215 of the rectangular table frame 205 and bolted in place to provide rigid support to the rectangular frame, and one latitudinal cross beam 225 is disposed centered and perpendicular to the left/right members 215 of the rectangular table frame 205 and bolted into place to provide further rigid support to the rectangular frame.

The higher table interface means of the second table 200 includes several components. Four stop bars 255, one at each end of each of the front/back members 210 of the rectangular table frame of the second movable table means 200 cooperate with four retaining guide mechanisms 260 disposed at a distance from each end of each of the front/back members 210 of said rectangular table frame to perform stopping and guiding functions relative to the third movable table 300. The guiding action may be seen with reference to FIG. 4B. The retaining guide mechanism 260 of the second table includes an upright member vertically disposed to the front/back member 210 to which it is affixed. A guide wheel 263 is rotatably attached to the upright member, and disposed horizontally so that the wheel rotates in a plane parallel to the track formed by the upper surface of the front/back frame member 210 over which it is mounted. Upon the track thus formed by the upper surface of the front/back frame member 210 of the second table, a corresponding front/back member 310 of the third table rides on an array of twin wheels 349, one set of which is shown in FIG. 4B, rotatably affixed to an axle assembly 347 attached to the bottom surface of the front/back member 310 of the third table. As the third table rides, moving from left to right, on the track formed by the front/back members 210 of the second table, the guide wheels 263 of the retaining guide mechanisms 260 of the second table guide the motion of the third table, and the stop bars 255 of the second table provide a limit to the motion of the third table.

The higher table interface means of the second table also includes a jack 265 pinned between the second and third movable tables by a clevis connector 236 on the top of the second movable table and a clevis connector 335 on the bottom of the third movable table. The jack 265 provides a mechanism by which motive force may be imparted to the third movable table 300 so as to translate the third movable table from left to right over the second table. Further description of the third movable table will follow as part of the subsequent discussion of the third table; what will be described next is the movement of the second movable table 200, which is movably positioned on the first movable table 100 by a lower table interface means.

The lower table interface means of the second movable table 200 includes several components. An array of roller ball caster mechanisms 245 is disposed equidistantly along the bottom surface of each of the left/right members 215 of the rectangular table frame of the second moving table means 200. An array of roller ball caster mechanisms 245 is disposed along the bottom surface near the center of each of the front/back members 210 of the rectangular table frame of the second movable table means 200. The angled plates 130 and rectangular plates 133 (reference FIG. 3) of the first movable table 100 provide a track on which the rollers of the second movable table ride. The lower table interface means is shown in more detail in FIG. 4A, and includes a tubular housing 247 vertically oriented to the left/right frame member 215 of the rectangular table frame, and a ball roller 249 seated within the concave opening of the tubular housing. The second movable table means 200 is thus movably seated on top of the first movable table means 100, with each array of roller ball caster mechanisms 245 of the second table 200 riding on one of the angular plates 130 or rectangular plates 133 of the first table 100.

A pivot post 70 (reference FIG. 2) runs vertically upward from the vehicle frame box 10 of the vehicle assembly 1 to the center post hole 240 (reference FIG. 4) of the latitudinal cross beam 225 of the rectangular table of the second movable table means 200. The second movable table means is thereby rotatably attached to the said vehicle frame box 10 with the pivot post 70 providing an axis of rotation.

With the second movable table means 200 movably positioned on top of the first movable table means 100 and rotatably attached to the vehicle frame box 10, movement is imparted to the second movable table 200 by the jacks 165 of the first movable table 100. Motive force is applied by said jacks at contact points 235 on the bottom of the second movable table means so as to impart rotational motion to said second movable table. The range of motion of the jacks 165 imparts a corresponding range of rotational motion to the second movable table.

The Third Movable Table (Left/Right Motion)

Now turning to FIG. 5, the third movable table means 300 can be seen to include (a) a deck means, not separately numbered, for defining a rigid table, (b) a lower table interface means, not separately numbered, for connecting to the second movable table 200, and (c) a higher table interface means, not separately numbered, for connecting to the fourth movable table 400.

The deck means of the third movable table 300 comprises a rectangular table frame which includes two front/back frame members 310 and two left/right frame members 315 bolted together to form a rigid rectangular frame. The left/right members 315 of the preferred embodiment are eighteen feet long steel beams, and the front/back members 310 are twenty feet long steel beams. Two longitudinal cross beams 320 are disposed parallel to the left/right members 315 of the rectangular table frame and bolted in place to provide rigid support to the rectangular frame, and one latitudinal cross beam 325 is disposed centered and perpendicular to the left/right members 315 of the rectangular table frame and bolted into place to provide further rigid support to the rectangular frame.

The higher table interface means 354 of the third table 300 includes several components. Four stop bars 355, one at each end of each of the left/right members 315 of the rectangular table frame of the third movable table means 300 cooperate with four retaining guide mechanisms 360 disposed at a distance from each end of each of the left/right members 315 of said rectangular table frame to perform stopping and guiding functions relative to the fourth movable table 400. The guiding action is analogous to that already discussed with reference to a previous table and with reference to FIG. 4B. Without a separate figure, but remembering the features shown by FIG. 4B, the retaining guide mechanisms 360 of the third table can be readily understood to include an upright member, not separately numbered or shown (but substantially the same as the equivalent member shown in FIG. 4B), vertically disposed to the left/right member 315 to which it is affixed. A guide wheel, not separately numbered or shown (but substantially the same as the equivalent wheel 263 shown in FIG. 4B) is rotatably attached to the upright member, and disposed horizontally so that the wheel rotates in a plane parallel to the track formed by the upper surface of the left/right frame member 315 over which it is mounted. Upon the track thus formed by the upper surface of the left/right frame member 315 of the third table, a corresponding left/right frame member 415 (reference FIG. 6) of the fourth table rides on an array of twin wheels 445, substantially the same as those shown in FIG. 4B but attached to the bottom surface of the left/right frame members 415 of the fourth table. As the fourth table rides, moving from front to back, on the track formed by the left/right members 315 of the third table, the guide wheels of the retaining guide mechanisms 360 of the third table guide the motion of the fourth table, and the stop bars 355 of the third table provide a limit to the motion of the fourth table.

The higher table interface means of the third table also includes a jack 365 pinned between the third and fourth movable tables by a clevis connector 336 on the top of the third movable table and a clevis connector 435 on the bottom of the fourth movable table. The jack 365 provides a mechanism by which motive force may be imparted to the fourth movable table 400 so as to translate the fourth movable table from front to back over the third table. Discussion of the fourth movable table will follow as part of the subsequent discussion of the fourth table; what will be described next is the movement of the third movable table 300, which is movably positioned on the second movable table 200 by a lower table interface means.

The lower table interface means of the third movable table 300 includes several components. An array of wheels 345 is disposed equidistantly along the bottom surface of each of the front/back members 310 of the rectangular table frame of the third movable table means 300. The wheels have already been shown in more detail in FIG. 4B and include a shaft and axle 347 and twin wheels 349 mounted on either end of each axle. The third movable table means 300 is slidably seated on top of the second movable table means 200, with each wheel array tracking along the narrow horizontal planar track formed by the top surface of the front/back members 210 of the rectangular table frame of the second movable table means 200. Retaining guide mechanisms 260 of the second movable table means 200 include a roller element 263 that both guides the sliding motion of the third movable table means 300 and retains the third movable table in its position as it translates across the second movable table. Stop bars 255 of the second movable table means 200 prevent the third movable table means 300 from travelling too far in its translational motion. The working of these elements has already been described with reference to FIG. 4B.

With the third movable table means 300 slidably positioned on top of the second movable table means 200 and restrained by the stop bars 255 of the said second movable table means, left and right lateral movement is imparted to said third movable table by the jack 265 of the second movable table 200. Motive force is applied by said jack at a contact point 335 on the bottom of the third movable table means 300 so as to impart left/right motion to said third movable table. The range of lateral motion is approximately four feet, measured as two feet to the left of center and two feet to the right of center, facing the system head on.

The Fourth Movable Table (Front/Back Motion)

Figure 6:
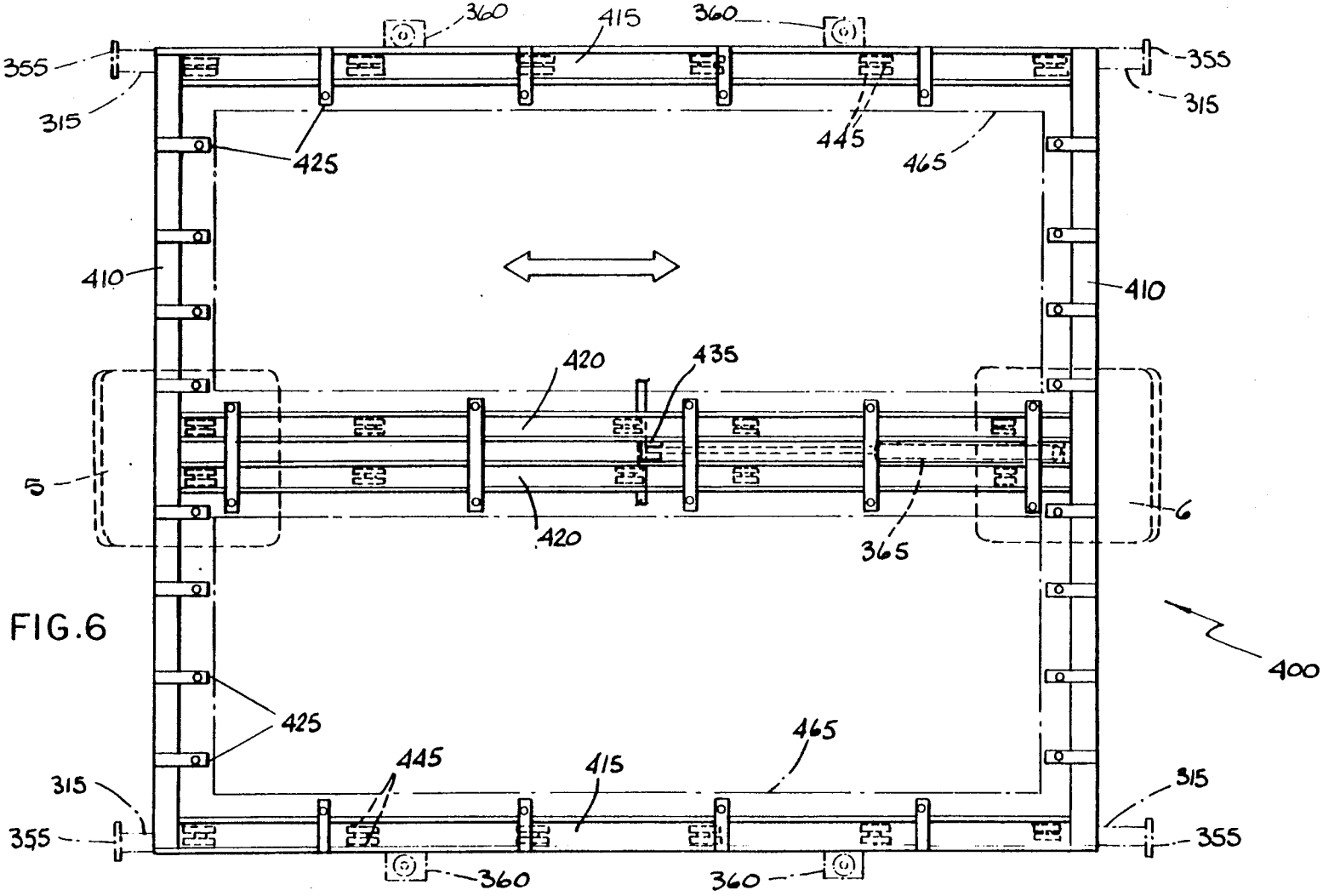
FIG. 6 is a plan view of the fourth movable table (front and back motion).
Figure 6A:
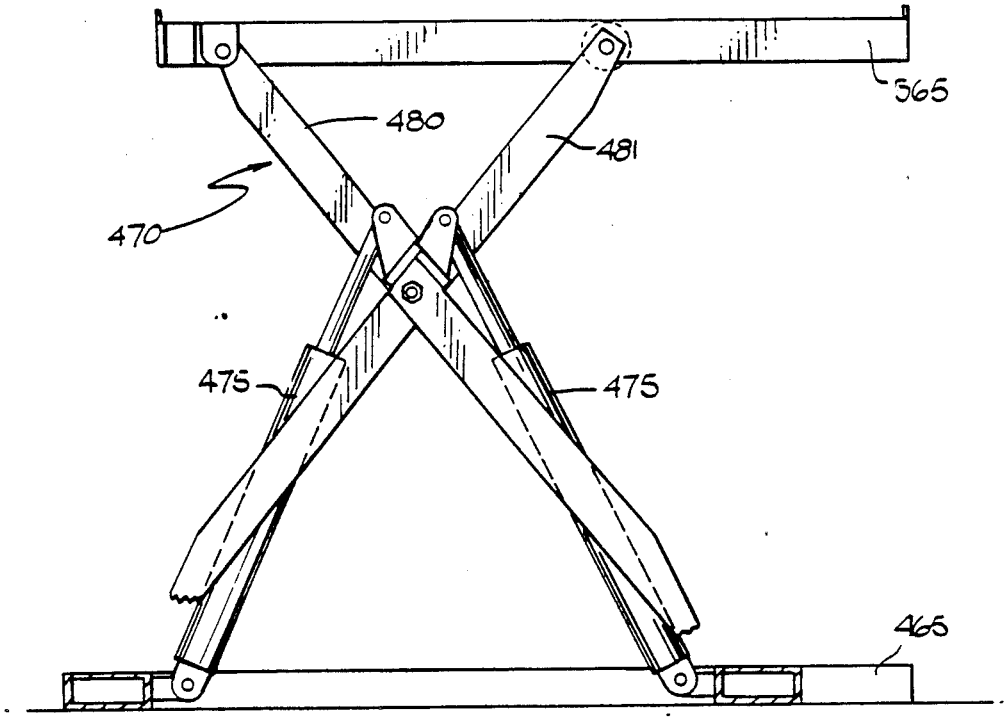
FIG. 6A is a detail view, from the side, of the scissors lift indicated in FIG. 6.

Now turning to FIG. 6, the fourth movable table means 400 can be seen to include (a) a deck means, not separately numbered, for defining a rigid table, (b) a lower table interface means, not separately numbered, for connecting to the third movable table 300, and (c) a higher table interface means, not separately numbered, for connecting to the fifth movable table 500.

The deck means of the fourth movable table 400 comprises a rectangular table frame which includes two front/back frame members 410 and two left/right frame members 415 bolted together to form a rigid rectangular frame. The left/right members 415 of the preferred embodiment are eighteen feet long steel beams, and the front/back members 410 are twenty feet long steel beams. Two longitudinal cross beams 420 are disposed parallel to the left/right members 415 of the rectangular table frame and bolted in place to provide rigid support to the rectangular frame.

The higher table interface means of the fourth table 400 includes several components. A suitable number of clips 425 secure the bottom frames 465 of each of a pair of scissors lifts 470 (reference FIG. 1) into place on the fourth table. As can be seen with reference to FIG. 6A, each scissors lift 470 includes a left scissors member 480, a right scissors member 481, and a set of hydraulic scissors jacks 476. Motive force imparted through the scissors jacks 476 propels the left and right scissors members 480 and 481 upwards. The top frame 565 of each pair of scissors lifts is secured to the fifth table, as will be described later, so that the scissors lifts provide motive force to the fifth movable table 500. Discussion of the fifth movable table will follow as part of the subsequent discussion of the fifth table; what will be described next is the movement of the fourth movable table 400, which is movably positioned on the third movable table 300 by a lower table interface means.

The lower table interface means of the fourth movable table 400 includes several components. An array of wheels 445 is disposed equidistantly along the bottom surface of each of the left/right members 415, and the longitudinal cross beams 420, of the rectangular table frame of the fourth movable table means 400. The wheels are identical to those on the bottom of the third movable table and already discussed in detail in connection with FIG. 4B. The fourth movable table means 400 is slidably seated on top of the third movable table means 300, with each wheel array tracking along the narrow horizontal planar track formed by the top surface of the left/right members 315, and longitudinal cross beams 320, of the rectangular table frame of the third movable table means 300. Retaining guide mechanisms 360 of the third movable table means, previously described, both guide the sliding motion of the fourth movable table means 400 and retain the fourth movable table in its position as it translates across the third movable table. Stop bars 355 of the third movable table means 300 prevent the fourth movable table means 400 from travelling too far in its translational motion.

With the fourth movable table means 400 slidably positioned on top of the third movable table means 300 and restrained by the stop bars 355 of the said third movable table means, front and back lateral movement is imparted to said fourth movable table by the jack 365 of the third movable table 300. Motive force is applied by said jack at a contact point 435 on the bottom of the fourth movable table means 400 so as to impart front-/back motion to said fourth movable table. The range of lateral motion is approximately four feet, measured as two feet to the front and two feet to the back, facing the system from the side.

The Fifth Movable Table (Up/Down Motion)

Figure 7:
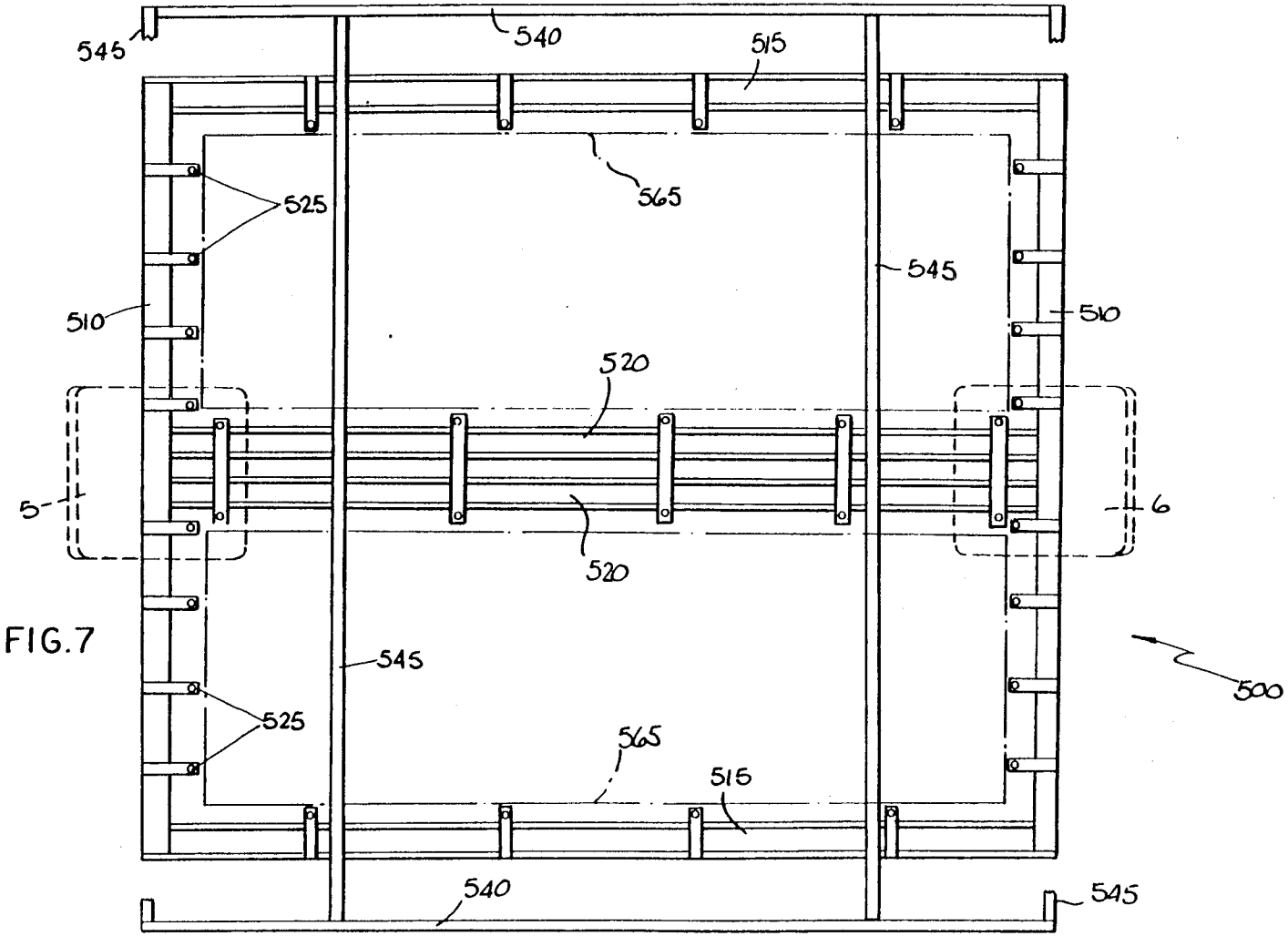
FIG. 7 is a plan view of the fifth movable table (up and down motion).

Now turning to FIG. 7, the fifth movable table means 500 can be seen to include (a) a deck means, not separately numbered, for defining a rigid table, (b) a lower table interface means, not separately numbered, for connecting to the fourth movable table 400, and (c) a higher table interface means, not separately numbered, for supporting a work bearing surface.

The deck means of the fifth movable table 500 comprises a rectangular table frame which includes two front/back frame members 510 and two left/right frame members 515 bolted together to form a rigid rectangular frame. The left/right members 515 of the preferred embodiment are eighteen feet long steel beams, and the front/back members 510 are twenty feet long steel beams. Two longitudinal cross beams 520 are disposed parallel to the left/right members 515 of the rectangular table frame and bolted in place to provide rigid support to the rectangular frame.

The higher table interface means of the fifth table 500 includes several components. A work deck, not separately numbered, comprises a second rectangular table frame bolted on top of the rectangular frame of the fifth table. The second rectangular frame includes two left/-right frame members 540 and, in the preferred embodiment, ten latitudinal cross beams 545, several of which are shown on FIG. 7. The left/right frame members 540 of the second rectangular table of the preferred embodiment are eighteen feet long, and the latitudinal cross beams 545 are approximately thirty feet long, so as to provide a work bearing surface that is approximately eighteen by thirty feet. As seen with reference to FIG. 1, and as previously discussed, the work bearing surface of the fifth movable table may also support a floor 535, hand railings 550 removably seated in railing pockets 551, and lookout stations 555 removably attached to the corners of the fifth table. The floor 535 may be made of wood, plywood or other suitable material. The hand railings 550 are provided about the periphery of the rectangular table frame for the convenience and safety of workers, and the lookout stations 555 are provided so that lookout operators in the stations may communicate with the operator of the system to assist the operator's precise adjustments of the work bearing surface of the system relative to the work face where the workpiece is to be delivered.

The lower table interface means of the fifth movable table includes several components. Clips 525, secure the top frames 565 of each of a pair of scissors lifts 470 (reference FIG. 1) into place on the fourth table. AS was already seen with reference to FIG. 6A, each scissors lift 470 includes a left scissors member 480, a right scissors member 481, and a set of hydraulic scissors jacks 476. Motive force imparted through the scissors jacks 476 propels the left and right scissors members 480 and 481 upwards. With the top frame 565 of each pair of scissors lifts secured to the fifth table, the scissors lifts provide motive force to the fifth movable table 500.

With the fifth movable table means 500 elevatably positioned on top of the fourth movable table means, an upward motion is imparted to said fifth movable table means by hydraulic pressure applied to the said scissors lifts. The range of upwards motion is approximately 13 feet, 6 inches, measured from the top of the fourth movable table means.

With reference to FIG. 1, and orienting the description, as we have been throughout this discussion, so that front and back refer to the forward motions afforded by the front vehicle operator cab 5 and back operator cab 6, and so that left and right refer to the motions indicated when facing one of the cabs head on, a summary of the range of motion provided by this invention can now be given briefly, together with a description of how to use the invention for placing tunnel roofing tiles.

A general range of freely driveable motion comes from the vehicle assembly 1 itself, which is, in the preferred embodiment, oriented perpendicularly to the work face and which can be driven forward at either cab. All other precision motion derives from the multi-table assembly 98. Leveling, as well as pitch/yaw motion, if desired, comes from the outriggers 145 of the first movable table means 100. Rotational motion comes from the second movable table means 200. Left/right motion comes from the third movable table means 300. Front/back motion comes from the fourth movable table means 400. Up/down motion comes from the fifth movable table means 500, which also constitutes the work bearing surface and the top table of the system. All of these assemblies and sub-assemblies have already been described in more detail previously in the description of this invention.

Using this invention for placing a roof in a tunnel, for example, an operator can drive the system into place, addressing the work face perpendicularly. The operator need not attempt to drive the system exactly into place because the great maneuverability afforded by the multi-table assembly 98 will permit all of the fine adjustments to be made so long as the operator has positioned the system reasonably close to the work face. The operator can then use the system to lift massive single pieces, or can have a crew assemble grids of tunnel ceiling tiles either (a) on a frame on the ground, and then lift the frame onto the top table of the system for placement, or (b) on the work bearing surface of the top table of the machine itself. Because of the full range of motion, and precise adjustments possible in each dimension, the operator can so adjust the rotational angle, pitch and yaw, left and right, and up and down orientation of the workpiece relative to the work face to make an exact placement of a massive piece of new roofing section. As a result, tile can be placed faster, more efficiently and more cheaply than could be done without this system. Further, the system is mobile, reusable and almost infinitely adjustable. The system is relatively easy to maintain because it uses standard parts and components, it is easy to drive and operate because it never needs to be backed up and because all four wheels steer, it is relatively inexpensive when compared to other mobile tunnel roofers, and it is more efficient than laying the ceiling tiles one by one.

While the use of the present invention has been described in the context of placing roof tiles in highway tunnels, it is easy to understand that the system may also be used to place siding tiles in highway tunnels, to do the same sort of work in quarry and other underground mines, and to do other work both above and below ground. The foregoing description of one use of the preferred embodiment of this invention is sufficient for those skilled in the trade readily to comprehend many other uses.

Various safety features, conventional and readily apparent to those skilled in the art, such as interlocking safety mechanisms and safety check valves for preventing and arresting movement in the event of power failure, load shifts, and the like are not separately shown or discussed.

What is claimed is:

1. A mobile and adjustable system for positioning an overhead workpiece by a system operator, comprising:

(a) transportation means for transporting the system and the operator;

(b) adjustable positioning means attached to the transportation means for positioning the workpiece, including a set of substantially parallel adjacently stacked tables, each said table being movably and adjustably attached to an adjacent said table, the table set being located above and mounted to the transportation means, the positioning means allowing adjustment in at least four of the following five positions: levelness (including pitch or yaw); rotational; lateral; longitudinal; and vertical; and (c) operation means operatively connected to said system for operating the transportation means and the adjustable positioning means.

2. The system of claim 1, wherein said operation means includes means for moving said tables relative to one another.

3. The system of claim 2, wherein said adjustable positioning means includes at least four of the following:

(a) an adjustable table included in said set of tables, for adjusting the pitch, yaw and levelness of the workpiece;

(b) an adjustable table included in said set of tables, for adjusting the rotational position of the workpiece;

(c) an adjustable table included in said set of tables, for adjusting the lateral position of the workpiece with respect to the transportation means;

(d) an adjustable table included in said set of tables, for adjusting the longitudinal position of the workpiece with respect to the transportation means;

(e) an adjustable table included in said set of tables, for adjusting the vertical position of the workpiece with respect to the transportation means.

4. The system of claim 3, wherein said adjustable table for adjusting the pitch, yaw and levelness of the workpiece includes a table frame and further comprising at least three outriggers one end of which are attached to the table frame and the other end of which are in contact with support means located lower than the table frame, the vertical dimension of the outriggers each being independently adjustable, whereby the independent adjustment of the vertical length of each of the outriggers adjusts the pitch, yaw and levelness of said table frame.

5. The system of claim 4, wherein said support means is the earth and the adjustment of the outriggers lifts the transportation means off the earth.

6. The system of claim 4, wherein said support means is the transportation means.

7. The system of claim 4, wherein said support means is the set of tables.

8. The system of claim 3, wherein said adjustable table for adjusting the rotational position of the workpiece includes a table frame and further comprising rotational attachment means attached to said adjustable positioning means for rotationally attaching said table frame to the adjustable positioning means.

9. The system of claim 8, wherein said rotational attachment means includes a set of rollers rollably attached to the table frame and riding on the adjustable positioning means.

10. The system of claim 9, wherein said rotational attachment means includes a roller track in said adjustable positioning means, whereby said rollers ride in said track.

11. The system of claim 3, wherein said adjustable table for adjusting the lateral position of the workpiece relative to the transportation means includes a table frame and further comprising laterally movable attachment means attached to said adjustable positioning means for laterally movably attaching said table frame to the adjustable positioning means.

12. The system of claim 11, wherein said laterally movable attachment means includes a set of rollers rollably attached to the table frame and riding on the adjustable positioning means.

13. The system of claim 12, wherein said laterally movable attachment means includes a roller track in said adjustable positioning means, whereby said rollers ride in said track.

14. The system of claim 3, wherein said adjustable table for adjusting the longitudinal position of the workpiece relative to the transportation means includes a table frame and further comprising longitudinally movable attachment means attached to said adjustable positioning means for longitudinally movably attaching said table frame to the adjustable positioning means.

15. The system of claim 14, wherein said longitudinally movable attachment means includes a set of rollers rollably attached to the table frame and riding on the adjustable positioning means.

16. The system of claim 15, wherein said longitudinally movable attachment means includes a roller track in said adjustable positioning means, whereby said rollers ride in said track.

17. The system of claim 3, wherein said adjustable table for adjusting the vertical position of the workpiece relative to the transportation means includes a table frame and further comprising elevatable attachment means attached to said adjustable positioning means for elevatably attaching said table frame to the adjustable positioning means.

18. The system of claim 17, wherein said elevatable attachment means includes a scissors lift one end of which is attached to said table frame and the other end of which is attached to the adjustable positioning means.

19. The system of claim 18, wherein said elevatable attachment means includes a second scissors lift one end of which is attached to said table frame and the other end of which is attached to the adjustable positioning means, and wherein the two scissors lifts are attached to opposite sides of the table frame.

20. The system of claim 3, further comprising at least one lookout station attached to the adjustable positioning means for holding a lookout operator to assist in the positioning of the workpiece.

21. The system of claim 20, wherein said lookout station is a cage suspended from the uppermost table.

22. The system of claim 1, wherein said transportation means includes a motor driven vehicle with a front end and a back end.

23. The system of claim 22, wherein said vehicle includes a front operation cab located at the front end of the vehicle and a back operation cab located at the back of the vehicle.

24. The system of claim 23, wherein said vehicle includes at least three wheels mounted to and supporting the vehicle.

25. The system of claim 23, wherein said vehicle includes at least four wheels mounted to and supporting the vehicle, at least two of said at least four wheels being driven by the motor and further comprising steering means attached to each of said at least four wheels for steering the vehicle.

26. The system of claim 22, wherein said operation means includes actuating means for adjusting the adjustable positioning means.

27. The system of claim 26, wherein said actuating means includes hydraulic jacks attached to and for moving the tables included in the set of tables.

28. A method for positioning an overhead assembly on the ceiling of a tunnel or underground space, comprising:

(a) placing the overhead assembly onto adjustable positioning means located over and mounted to the frame of a motor-driven vehicle, the adjustable positioning means including a set of substantially parallel adjacently stacked tables, each table being movably and adjustably attached to an adjacent said table so that the adjustable positioning means can position the overhead assembly with respect to at least four of the following five positions: levelness (including pitch or yaw), rotational position, lateral position relative to the vehicle, longitudinal position relative to the vehicle, and vertical position relative to the vehicle;

(b) driving the vehicle to a location such that the overhead assembly is positioned approximately directly below the desired ceiling position;

(c) operating the adjustable positioning means to position the overhead assembly to substantially the exact desired ceiling position.

29. The method of claim 28, further comprising:

(a) attaching the overhead assembly to the ceiling, and (b) driving the vehicle away from said location.

30. A mobile and adjustable system for positioning an overhead workpiece by a system operator, comprising:

(a) transportation means for transporting the system and the operator;

(b) adjustable positioning means attached to the transportation means for positioning the workpiece, including a set of substantially parallel adjacently stacked tables, each said table being movably and adjustably attached to an adjacent said table, the table set being located above and mounted to the transportation means, positioning means allowing adjustment in at least four of the following five positions: levelness (including pitch or yaw); rotational; lateral; longitudinal; and vertical;

(c) stabilizer means for stabilizing each of the tables, said stabilizer means including a support for each table sufficient to allow the topmost table to bear a load of at least 5,000 pounds; and (d) operation means operatively connected to said system for operating the transportation means and the adjustable positioning means.

31. The system of claim 30, wherein said stabilizer means includes:

(a) at least three outriggers one end of which are attached to one of the tables and the other end of which are in contact with the ground for stabilizing said tables;

(b) movable attachment means for movably attaching the tables, said attachment means including (i) a plurality of rollers attached between at least one pair of tables, said rollers being attached to one of the top and bottom of said tables so that the tables can ride relative to one another on said rollers, and (ii) at least one pair of scissors lifts attacted at one end to the bottom of a table and at the other end to the top of another table, at least a portion of said attachment means being disposed close enough to the periphery of said tables to provide support to stabilize the tables at their periphery.

32. The system of claim 31, wherein the adjustable positioning means allows adjustment in all of the following five positions: levelness (including pitch or yaw); rotational; lateral; longitudinal; and vertical.

33. A method for positioning an overhead assembly on the ceiling of a tunnel or underground space, comprising:

(a) placing the overhead assembly onto adjustable positioning means located over and mounted to the frame of a motor-driven vehicle, the adjustable positioning means including a set of substantially parallel adjacently stacked tables, each table being movably and adjustably attached to an adjacent said table so that the adjustable positioning means can position the overhead assembly with respect to at least four of the following five positions: levelness (including pitch or yaw), rotational position, lateral position relative to the vehicle, longitudinal position relative to the vehicle, and vertical position relative to the vehicle, and each table being supported by stabilizing means so that the topmost table can bear a load of at least 5,000 pounds;

(b) driving the vehicle to a location such that the overhead assembly is positioned approximately directly below the desired ceiling position;

(c) operating the adjustable positioning means to position the overhead assembly to substantially the exact desired ceiling position.

34. The method of claim 33, wherein said adjustable positioning means can position the overhead assembly with respect to all five of the following positions: levelness (including pitch or yaw), rotational position, lateral position relative to the vehicle, longitudinal position relative to the vehicle, and vertical position relative to the vehicle.

* * * * *